US011129506B2

(12) United States Patent
Grendel

(10) Patent No.: US 11,129,506 B2
(45) Date of Patent: Sep. 28, 2021

(54) REMOVABLE TOILET SEAT SYSTEM FOR A WALKER

(71) Applicant: Sonny Grendel, South Lyon, MI (US)

(72) Inventor: Sonny Grendel, South Lyon, MI (US)

( * ) Notice: Subject to any disclaimer, the term of this patent is extended or adjusted under 35 U.S.C. 154(b) by 0 days.

(21) Appl. No.: 16/409,012

(22) Filed: May 10, 2019

(65) Prior Publication Data

US 2020/0352400 A1 Nov. 12, 2020

(51) Int. Cl.
*A47K 11/04* (2006.01)
*A61H 3/00* (2006.01)

(52) U.S. Cl.
CPC ..... *A47K 11/04* (2013.01); *A61H 3/00* (2013.01); *A61H 2003/004* (2013.01); *A61H 2201/1633* (2013.01)

(58) Field of Classification Search
CPC ..... A61H 2003/004; A61H 2203/0425
USPC ..... 135/67
See application file for complete search history.

(56) References Cited

U.S. PATENT DOCUMENTS 2,369,040 A * 2/1945 Grady ..... A61G 5/00 280/219
2,866,495 A * 12/1958 Diehl ..... A61H 3/04 297/6
4,907,794 A * 3/1990 Rose ..... A61H 3/04 135/67
4,907,839 A * 3/1990 Rose ..... A61H 3/00 135/67
6,371,142 B1 * 4/2002 Battiston ..... A61H 3/04 135/66
8,480,100 B2 * 7/2013 Staggs ..... A61G 5/1002 135/67
9,662,264 B2 * 5/2017 Jacobs ..... A61H 3/04
2003/0178053 A1 * 9/2003 Wilensky ..... A61H 3/00 135/67
2007/0199586 A1 * 8/2007 Cheng ..... A61H 3/04 135/67
2008/0121258 A1 * 5/2008 Lin ..... A61H 3/00 135/67
2011/0187067 A1 * 8/2011 Staggs ..... A47K 3/12 280/30

* cited by examiner

*Primary Examiner* — David R Dunn
*Assistant Examiner* — Danielle Jackson
(74) *Attorney, Agent, or Firm* — The Iwashko Law Firm, PLLC; Lev Ivan Gabriel Iwashko

(57) ABSTRACT

A removable toilet seat system for a walker, including a seat portion removably connected to at least a portion of the walker to facilitate a user being disposed thereupon, and at least one seat-holding tab rotatably disposed on at least a portion of the walker to move from retracted in a first position to at least partially extracted in a second position, such that the seat portion is prevented from falling in response to a bottom surface of the seat portion contacting the at least one seat-holding tab.

2 Claims, 2 Drawing Sheets

REMOVABLE TOILET SEAT SYSTEM FOR A WALKER

BACKGROUND

1. Field

The present general inventive concept relates generally to a toilet seat system, and particularly, to a removable toilet seat system for a walker.

2. Description of the Related Art

One of the most significant barriers for postoperation orthopedic patients and disabled persons with limited mobility is the process of introducing the necessary safety modifications into their living environment. Medical equipment adaptations are often expensive and uncovered by insurance, as well as being undesirable to live with from a mental and psychical perspective.

Some postoperation orthopedic patients and disabled persons may have difficulty sitting and/or bending their knees, which can impact daily activities that requires moving to a low position, such as using a toilet. Unfortunately, even toilets for individuals with a handicap are positioned low to the ground.

Therefore, there is a need for a toilet seat that is portable and can be adjustably disposed at a height comfortable for a user.

SUMMARY

The present general inventive concept provides a removable toilet seat system for a walker.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a removable toilet seat system for a walker, including a seat portion removably connected to at least a portion of the walker to facilitate a user being disposed thereupon, and at least one seat-holding tab rotatably disposed on at least a portion of the walker to move from retracted in a first position to at least partially extracted in a second position, such that the seat portion is prevented from falling in response to a bottom surface of the seat portion contacting the at least one seat-holding tab.

The removable toilet seat system may further include a seat-moving string disposed on at least a portion of the seat portion at a first end of the seat-moving string to elevate the seat portion in response to a second end of the seat-moving string being moved away from the walker.

The removable toilet seat system may further include a control unit disposed on at least a portion of the walker to move at least one of the at least one seat-holding tab and the seat-moving string in response to depressing a button on the control unit.

The removable toilet seat system may further include at least one motor removably disposed on at least a portion of the walker to rotate in response to depressing the button on the control unit, such that at least one of the at least one seat-holding tab and the seat-moving string move in response to the rotation of the at least one motor.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
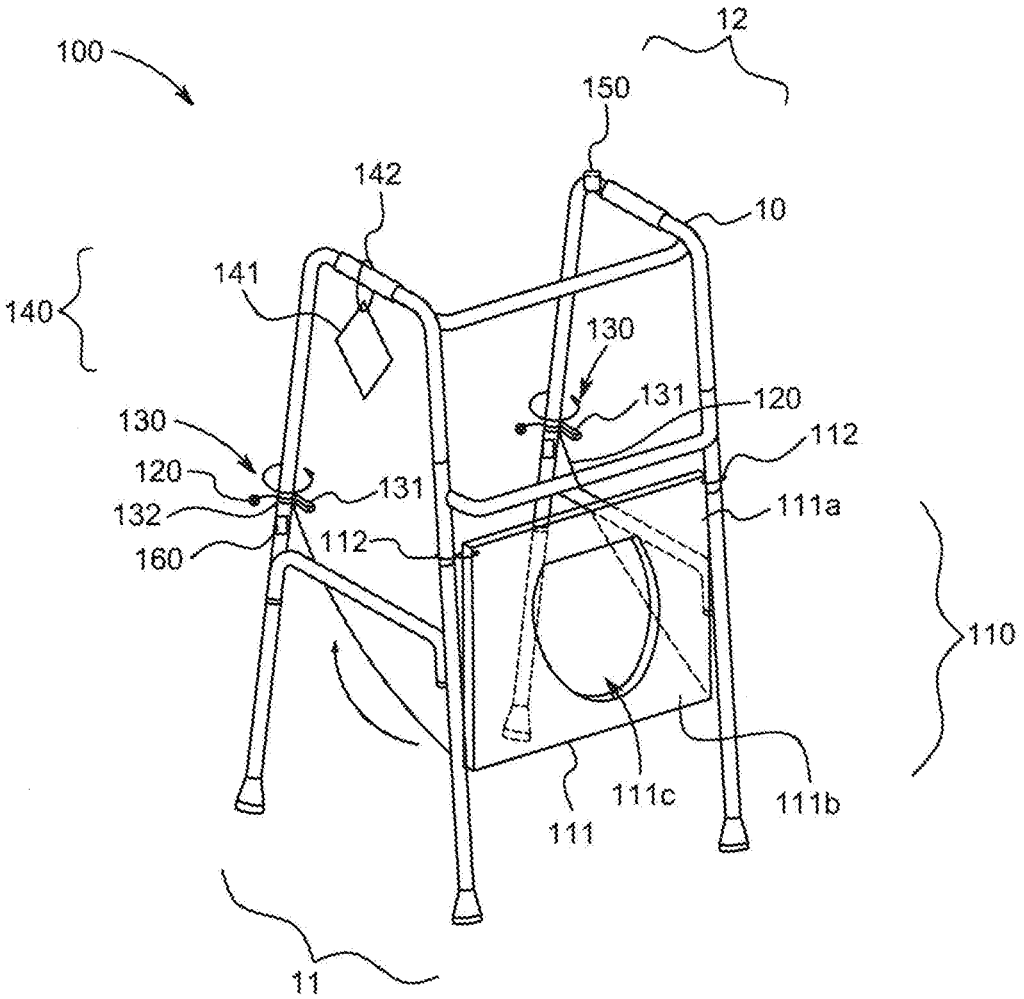
FIG. 1 illustrates a top isometric view of a removable toilet seat system in a lowered position, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Removable Toilet Seat System 100
Seat Portion 110
Main Body 111
Top Surface 111*a*
Bottom Surface 111*b*
Aperture 111*c*
Seat Fastener 112
Seat-Moving String 120
Seat-Holding Tab 130
Tab Portion 131
Loop Portion 132
Seat-Cleaning Container 140
Body 141
Container Fastener 142
Control Unit 150
Motor 160

FIG. 1 illustrates a top isometric view of a removable toilet seat system 100 in a lowered position, according to an exemplary embodiment of the present general inventive concept.

The removable toilet seat system 100 may be constructed from at least one of metal, plastic, wood, glass, and rubber, etc., but is not limited thereto. Additionally, the removable toilet seat system 100 may be hypoallergenic.

The removable toilet seat system 100 may be removably disposed on any type of walker 10. For example, the removable toilet seat system 100 may be removably disposed on the walker 10 that has no wheels and/or a locking mechanism connected to the wheels of the walker 10.

The removable toilet seat system 100 may include a seat portion 110, at least one seat-moving string 120, at least one seat-holding tab 130, a seat-cleaning container 140, a control unit 150, and at least one motor 160 but is not limited thereto.

The seat portion 110 may include a main body 111 and a plurality of seat fasteners 112, but is not limited thereto.

The plurality of seat fasteners 112 may include a twine, a string, a rope, a magnet, a clasp, a hook, a screw, a nail, a bolt, a nut, a washer, and/or any combination thereof, but is not limited thereto.

The main body 111 may include a top surface 111*a*, a bottom surface 111*b*, and an aperture 111*c*, but is not limited thereto.

Figure 2:
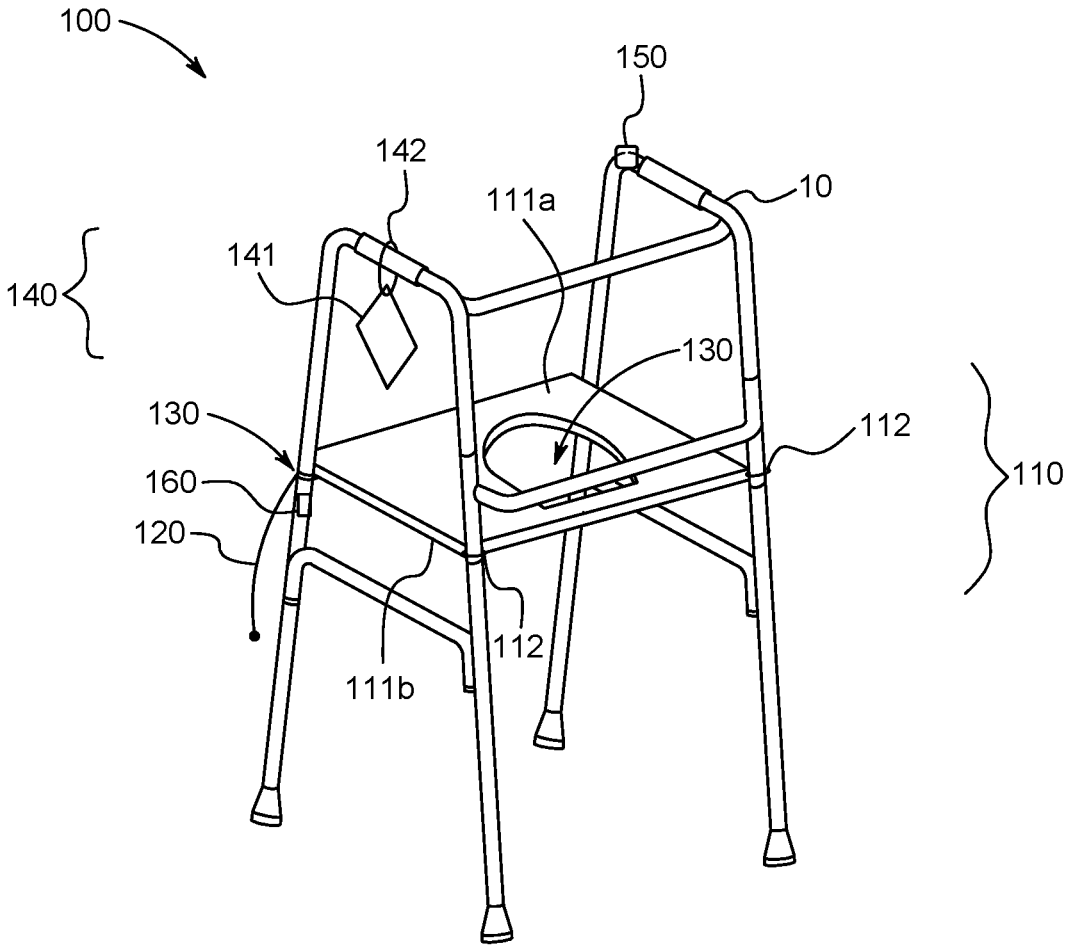
FIG. 2 illustrates a top isometric view of the removable toilet seat system in a raised position, according to an exemplary embodiment of the present general inventive concept.

Referring to FIGS. 1 through 2, the main body 111 is illustrated to have a rectangular prism shape. However, the main body 111 may be rectangular, circular, pentagonal, hexagonal, octagonal, or any other shape known to one of ordinary skill in the art, but is not limited thereto.

The main body 111 may be removably connected to at least a portion of the walker 10. The main body 111 may have any predetermined size based on a size of a user. For example, the main body 111 may be at least one of a bariatric size, a standard size, and a pediatric size, but is not limited thereto. Additionally, each of the plurality of seat fasteners 112 may be removably connected to at least a portion of at least one side of the main body 111, such as near a corner of the main body 111, and at least a portion of the walker 10, such that the main body 111 may be suspended from the walker 10.

Moreover, each of the plurality of seat fasteners 112 may adjust along a height of the walker 10 to accommodate a preference of the user. For example, the user may adjust a height of the main body 111 along the height of the walker 10 based on an extent a back and/or knees of the user may bend.

The at least one seat-moving string 120 may be disposed on at least a portion of the main body 111 at a first end. Specifically, the at least one seat-moving string 120 may be disposed on at least a portion of the top surface 111*a* and/or the bottom surface 111*b*, but is not limited thereto.

The at least one seat-holding tab 130 may include a tab portion 131 and a loop portion 132, but is not limited thereto.

The at least one seat-holding tab 130 may be rotatably disposed on at least a portion of the walker 10. Specifically, the loop portion 132 may be rotatably disposed on at least a portion of a first side 11 or a second side 12 of the walker 10 corresponding to the height of each of the plurality of fasteners 112, but is not limited thereto. Alternatively, the loop portion 132 may be rotatably disposed higher or lower than each of the plurality of fasteners 112.

As such, the at least one seat-holding tab 130 may rotate in a first direction (i.e. clockwise) or a second direction (i.e. counterclockwise) from retracted in a first position to at least partially extracted in a second position, such that the tab portion 131 may be pointed toward the second side 12 or the first side 11 of the walker 10. Moreover, the at least one seat-holding tab 130 may rotate in the second direction or the first direction from at least partially extracted in the second position to retracted in the first position, such that the tab portion 131 may be in parallel with the first side 11 or the second 12 of the walker 10.

Alternatively, the at least one seat-holding tab 130 may be removably disposed within the first side 11 or the second 12 of the walker 10, such that the tab portion 131 may move from retracted within the first side 11 or the second 12 in the first position to at least partially extended out of the first side 11 or the second side 12 in the second position, such that the tab portion 131 may protrude toward the second side 12 or the first side 11 of the walker 10. Moreover, the at least one seat-holding tab 130 may move from at least partially extended out of the first side 11 or the second side 12 in the second position to retracted within the first side 11 or the second side 12 in the first position, such that the tab portion 131 may not be visible on the walker 10.

Also, a second end of the at least one seat-moving string 120 may by inserted through at least a portion of the loop portion 132 of the at least one seat-holding tab 130 to hold the second end of the at least one seat-moving string 120. As such, the loop portion 132 may facilitate gripping the second end of the at least one seat-moving string 120.

FIG. 2 illustrates a top isometric view of the removable toilet seat system 100 in a raised position, according to an exemplary embodiment of the present general inventive concept.

Initially, the user may push and/or pull the walker 10 to a bathroom and orient the walker 10 over a toilet.

Furthermore, the user may grip at least a portion of the second end of the at least one seat-moving string 120 to push and/or pull the at least one seat-moving string 120 away from the walker 10, such that the seat portion 110 may move in response to movement of the at least one seat-moving string 120. The seat portion 110 may be moved to at least above the tab portion 131 of the at least one seat-holding tab 130, such that the user may lower the seat portion 110 onto the tab portion 131. Additionally, the seat portion 110 may be at least partially aligned over a seat of the toilet. The user may further move the walker 10 to align the aperture 111*c* with an aperture on the toilet.

Additionally, the seat portion 110 may lock upon the tab portion 131 in response to a weight applied upon the top surface 111*a* of the main body 111. For example, the seat portion 110 may lock upon the tab portion 131 in response to the user sitting thereupon. The seat portion 110 may release from the tab portion 131 in response to an absence of the weight upon the top surface 111*a* of the main body 111.

As such, the seat portion 110 may facilitate the user sitting thereupon at a comfortable height for the user, such that the user may not bend the knees and/or the back in a manner that causes discomfort. As such, the user may use the toilet without bending the knees and/or the back of the user.

The seat-cleaning container 140 may include a body 141 and a container fastener 142, but is not limited thereto.

The container fastener 142 may include a twine, a string, a rope, a magnet, a clasp, a hook, a screw, a nail, a bolt, a nut, a washer, and/or any combination thereof, but is not limited thereto.

The body 141 may store at least one seat-cleaning wipe therein. The user may extract the at least one seat-cleaning wipe to clean at least a portion of the top surface 111*a*, the bottom surface 111*b*, and/or the aperture 111*c* of the main body 111.

Furthermore, the user may removably dispose a disposable seat gasket on at least a portion of the top surface 111*a* of the main body 111 to cover the main body 111, such that the disposable seat gasket may prevent the main body 111 from being soiled. Subsequently, the user may eliminate the disposable seat gasket after usage.

The body 141 may be removably connected to the walker 10 via the container fastener 142.

The control unit 150 may include at least one of a button, a switch, a lever, and a knob, but is not limited thereto.

The control unit 150 may be removably disposed on at least a portion of the walker 10.

The control unit 150 may be electrically and/or mechanically connected to the at least one motor 160. The at least one motor 160 may be removably disposed on at least a portion of the walker 10, such as near at least one of the at least one seat-moving string 120 and the at least one seat-holding tab 130. Also, the second end of the at least one seat-moving string 120 may be removably connected to at least a portion of the at least one motor 160. The at least one motor 160 may rotate in response to a manipulation of the control unit 150 by the user. The second end of the at least one seat-moving string 120 may move away from the walker 10 in response to the rotation of the at least one motor 160.

Alternatively, or in addition thereto, the at least one seat-holding tab 130 may be removably connected to at least a portion of the at least one motor 160. Therefore, the at least one seat-holding tab 130 may rotate in response to the rotation of the at least one motor 160.

As such, the user may manipulate the control unit 150 to move the seat portion 110 and/or enable the seat portion 110 to be connected to the at least one seat-holding tab 130.

Therefore, the removable toilet seat system 100 may facilitate the user using the toilet without having to bend the knees and/or the back of the user. Moreover, the user may not need to expend resources modifying a bathroom in a home to cater to the user's disability. The removable toilet seat system 100 may be an ideal solution for any user that has mobility difficulties, such as postoperation orthopedic patients.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A removable toilet seat system for a walker, comprising:

a seat portion removably connected to at least a portion of the walker to facilitate a user being disposed thereupon;

at least one seat-holding tab rotatably disposed on at least a portion of the walker to move from retracted in a first position to at least partially extracted in a second position, such that the seat portion is prevented from falling in response to a bottom surface of the seat portion contacting the at least one seat-holding tab;

a seat-moving string disposed on at least a portion of the seat portion at a first end of the seat-moving string to elevate the seat portion in response to a second end of the seat-moving string being moved away from the walker; and a control unit disposed on at least a portion of the walker to move at least one of the at least one seat-holding tab and the seat-moving string in response to depressing a button on the control unit.

2. A removable toilet seat system for a walker, comprising:

a seat portion removably connected to at least a portion of the walker to facilitate a user being disposed thereupon;

at least one seat-holding tab rotatably disposed on at least a portion of the walker to move from retracted in a first position to at least partially extracted in a second position, such that the seat portion is prevented from falling in response to a bottom surface of the seat portion contacting the at least one seat-holding tab;

a seat-moving string disposed on at least a portion of the seat portion at a first end of the seat-moving string to elevate the seat portion in response to a second end of the seat-moving string being moved away from the walker;

a control unit disposed on at least a portion of the walker to move at least one of the at least one seat-holding tab and the seat-moving string in response to depressing a button on the control unit; and at least one motor removably disposed on at least a portion of the walker to rotate in response to depressing the button on the control unit, such that at least one of the at least one seat-holding tab and the seat-moving string move in response to the rotation of the at least one motor.

* * * * *